US009926164B2

(12) United States Patent
Jeschke et al.

(10) Patent No.: US 9,926,164 B2
(45) Date of Patent: Mar. 27, 2018

(54) APPARATUS AND METHOD FOR FILLING A THIN-WALLED TRANSPORT CONTAINER

(71) Applicant: WINCOR NIXDORF INTERNATIONAL GMBH, Paderborn (DE)

(72) Inventors: Andreas Jeschke, Dallgow (DE); Mirko Duchstein, Berlin (DE)

(73) Assignee: Diebold Nixdorf, Incorporated, North Canton, OH (US)

( * ) Notice: Subject to any disclaimer, the term of this patent is extended or adjusted under 35 U.S.C. 154(b) by 684 days.

(21) Appl. No.: 14/362,321

(22) PCT Filed: Dec. 3, 2012

(86) PCT No.: PCT/EP2012/074221
§ 371 (c)(1),
(2) Date: Jun. 2, 2014

(87) PCT Pub. No.: WO2013/079717
PCT Pub. Date: Jun. 6, 2013

(65) Prior Publication Data

US 2014/0331612 A1 Nov. 13, 2014

(30) Foreign Application Priority Data

Dec. 2, 2011 (DE) ..... 10 2011 055 992

(51) Int. Cl.
*B65H 31/30* (2006.01)
*B65B 35/04* (2006.01)
(Continued)

(52) U.S. Cl.
CPC ..... *B65H 31/3054* (2013.01); *B65B 5/08* (2013.01); *B65B 5/106* (2013.01); *B65B 25/14* (2013.01);
(Continued)

(58) Field of Classification Search
CPC B65B 5/067; B65B 5/061; B65B 5/08; B65B 5/106; B65B 25/14; B65B 35/04;
(Continued)

(56) References Cited

U.S. PATENT DOCUMENTS 1,628,488 A * 5/1927 Crowe ..... B65H 18/20 74/613
1,991,411 A * 2/1935 Novick ..... B65H 29/44 271/181
(Continued)

FOREIGN PATENT DOCUMENTS

DE 4328136 3/1995
EP 0333102 A2 * 9/1989 ..... B65H 29/46
(Continued)

OTHER PUBLICATIONS

International Search Report of Aug. 21, 2013.
German Search Report of Jul. 10, 2012.

*Primary Examiner* — Michelle Lopez
*Assistant Examiner* — Lucas Palmer
(74) *Attorney, Agent, or Firm* — Black, McCuskey, Souers & Arbaugh, LPA

(57) ABSTRACT

A device (10, 100) for supplying notes of pecuniary value (24) to a thin-walled transport container (12) includes a stacking unit (20) for stacking the notes of pecuniary value (24) to be supplied to form a stack of notes of pecuniary value in a stacking region (26). In addition, the device (10, 100) has a closure unit (40) which, in a closed position, is arranged in such a manner that it closes the opening of the thin-walled transport container (12) and which, in an open position, is arranged in such a manner that notes of pecuniary value (24) are suppliable to the thin-walled transport container (12)

8 Claims, 7 Drawing Sheets

(51) Int. Cl.
*B65B 5/08* (2006.01)
*B65B 5/10* (2006.01)
*B65B 25/14* (2006.01)

(52) U.S. Cl.
CPC ..... *B65B 35/04* (2013.01); *B65H 31/309* (2013.01); *B65H 2301/42146* (2013.01); *B65H 2404/1114* (2013.01); *B65H 2405/212* (2013.01); *B65H 2405/311* (2013.01); *B65H 2701/1912* (2013.01)

(58) Field of Classification Search
CPC ..... B65B 31/309; B65H 2701/1912; B65H 31/3054
USPC ..... 413/213, 214, 121, 103
See application file for complete search history.

(56) References Cited

U.S. PATENT DOCUMENTS 4,306,399 A * 12/1981 Tsujimoto ..... B65B 43/30 53/385.1
4,474,365 A * 10/1984 DiBlasio ..... B65H 5/062 271/116
4,512,263 A * 4/1985 Lanning ..... B65H 31/14 109/24.1
4,593,896 A * 6/1986 Nakamura ..... B65H 29/40 271/186
4,711,441 A * 12/1987 Taylor ..... B65H 7/00 271/111
5,014,495 A * 5/1991 Bolejack ..... B65B 5/067 53/157
5,173,195 A * 12/1992 Wright ..... B01D 17/0211 210/237
5,405,226 A * 4/1995 Daves ..... B60P 7/15 211/4
5,464,316 A * 11/1995 Kranz ..... B65H 29/40 198/418.7
5,766,555 A * 6/1998 Grochowski ..... B01D 53/08 422/129
5,799,465 A * 9/1998 Townsend ..... B65B 5/067 53/257
9,096,404 B2 * 8/2015 Duchstein ..... B65B 5/106
9,311,765 B2 * 4/2016 Akamatsu ..... G07D 11/00
9,466,167 B2 * 10/2016 Razzaboni ..... B65B 25/14
2002/0108355 A1 * 8/2002 Vignoli ..... B65B 5/067 53/459
2002/0124533 A1 * 9/2002 Schmetzer ..... B65B 5/067 53/438
2005/0211721 A1 * 9/2005 Chirnomas ..... B65G 47/912 221/123
2008/0060906 A1 * 3/2008 Fitzgerald ..... G07D 11/0081 194/207
2008/0061497 A1 * 3/2008 Ishikawa ..... B65H 31/24 271/207
2011/0042889 A1 * 2/2011 Holland-Letz ..... B65H 29/40 271/264
2011/0316220 A1 * 12/2011 Yoshii ..... B65H 3/48 271/11
2012/0067011 A1 3/2012 Holland-Letz et al.
2014/0001703 A1 * 1/2014 Petermann ..... G07D 11/0012 271/220
2014/0138471 A1 * 5/2014 Daul ..... B65H 35/02 242/525

FOREIGN PATENT DOCUMENTS

JP 58-12084 1/1983
JP 2002109605 4/2002
JP 2002109605 A * 4/2002
JP 2006228094 A * 8/2006
JP 2007034869 A * 2/2007
JP 2008191767 A * 8/2008
WO WO 2009138497 A1 * 11/2009 ..... B65B 9/15
WO WO 2010108841 A2 * 9/2010 ..... B65B 5/108

* cited by examiner

APPARATUS AND METHOD FOR FILLING A THIN-WALLED TRANSPORT CONTAINER

BACKGROUND

1. Field of the Invention

The invention relates to a device for filling a thin-walled transport container comprising an opening with notes of pecuniary value, wherein the device includes a stacking unit for stacking the notes of pecuniary value to be supplied to the thin-walled transport container in a stacking region, which is arranged outside the transport container, to form a stack of notes of pecuniary value. In addition, the invention relates to a method for filling a thin-walled transport container by means of said device.

2. Description of the Related Art

For receiving notes of pecuniary value, in particular for receiving notes of pecuniary value which do not have to be paid out again, in cash machines, automatic teller machines and/or automatic safes, more and more use is made of thin-walled transport containers, so-called safebags, in which the notes of pecuniary value are received similar to a plastic bag. Once the safebag has been filled with the notes of pecuniary value, the safebag is closed in a tamper-proof manner, preferably fully automatically, such that the notes of pecuniary value are able to be transported in a simple manner by means of the safebag without much space being required for this.

Document DE 10 2009 015 047 A1 makes known a device for filling a thin-walled transport container which comprises a stacking unit. By means of stacker wheels, in which the notes of pecuniary value are received, the notes of pecuniary value are stacked on a displacement unit to form a stack of notes of pecuniary value. By means of the displacement unit, the stack of notes of pecuniary value is then displaced at least by such an amount that between the opening of the transport container and the note of pecuniary value supplied the last there is a predetermined minimum spacing such that the transport container is able to be closed.

The problem with said known device is, on the one hand, that the notes of pecuniary value are stacked directly inside the opening of the transport container such that errors can easily occur during stacking, for example notes of pecuniary value not being deposited correctly on their edge. In addition, depositing using stacker wheels is problematic to the effect that on account of different speeds between a supplying unit for supplying the notes of pecuniary value and the stacker wheels as well as different spacings between the notes of pecuniary value, secure depositing of the notes of pecuniary value to form the stack of notes is only possible with difficulty.

It is the object of the invention to provide a device and a method for filling a thin-walled transport container comprising an opening with notes of pecuniary value, by means of which the notes of pecuniary value are reliably suppliable in a simple manner to the transport container.

SUMMARY OF THE INVENTION

According to the invention, the stacking region, in which the notes of pecuniary value are stacked by means of the stacking unit, is arranged outside the transport container, in particular outside the opening of the transport container. In addition, there is provided a closure unit which, in a closed position, closes the opening of the thin-walled transport container at least by an amount such that the stack of notes of pecuniary value is not suppliable to the thin-walled transport container, and which, in an open position, is arranged in such a manner that the stack of notes of pecuniary value is suppliable to the thin-walled transport container. As a result, it is achieved that the notes of pecuniary value are able to be stacked reliably and securely initially in the stacking region, which is separated from the transport container by the closure unit, before the closure unit is then moved into the open position and the created stack of notes of pecuniary value is reliably suppliable through the opening to the thin-walled transport container. In particular, the closure unit can consequently be utilized for feeding the notes of pecuniary value such that the expensive supplying using stacker wheels can be dispensed with and the notes of pecuniary value are able to be stacked at a high speed, in particular by means of impellers.

In addition, it is advantageous when there is provided at least one supplying region which extends through the opening of the transport container, through which supplying region the stack of notes of pecuniary value is suppliable from the stacking region to a receiving region of the transport container in which the notes of pecuniary value are permanently received. In particular, there is provided a supporting element by means of which the notes of pecuniary value are supplied from the stacking region through the supplying region to the receiving region. The closure unit, in the closed position, separates the stacking region from the supplying region and, in the open position, opens up the supplying region such that the stack of notes of pecuniary value is movable from the stacking region via the supplying region further into the receiving region of the transport container. In particular, there is provided a fixed-in-position supporting element, on which notes of pecuniary value stacked in the stacking region are stacked to form a stack of notes of pecuniary value. In particular several ramps which project from the stacking region into the supplying region, and consequently into the opening of the transport container and on which the notes of pecuniary value slide when being supplied to the receiving region, are arranged on said supporting element. The ramps are in each case in particular resiliently mounted such that it is possible to assemble the transport container in a particularly simple manner.

The transport container is, in particular, a bag, preferably a bag of plastics material. The thin-walled transport container is also designated in particular as a safebag. The safebag is pulled over a closure frame in particular with its inside surface turned to the outside. When filling the safebag, this latter is gradually turned again from its inside surface to the outside surface as a result of the supplying of the notes of pecuniary value or of the stack of notes of pecuniary value such that the notes of pecuniary value are received in the inside region.

The closure frame serves, in particular, not only for holding open the opening of the thin-walled transport container, but additionally also for closing the transport container irreversibly once it has been filled. To this end, at least one side of the frame preferably comprises first latching elements and a second side of the frame, which is located opposite the first side, comprises second latching elements which are realized so as to be complementary to the first latching elements and into which the first latching element latch when the first and the second sides are moved toward one another. In particular, the latching connection created as a result cannot be released nondestructively such that an opening of the transport container and consequently access to the notes of pecuniary value is only possible as a result of destruction of the transport container and/or of the closure frame and consequently attempts at manipulation are able to be promptly detected.

The closure unit is movable in particular in a translatory manner between the closed and the open position such that a particularly simple design is achieved. In the case of a particularly preferred embodiment, the closure unit is realized in the form of a Venetian blind such that only a small amount of installation space is required by the closure unit. In particular, it is not necessary to provide a space into which the closure unit is moved when it is arranged in the open position.

The Venetian blind includes, in particular, a woven fabric web such that a particularly simple and cost-efficient design is achieved.

It is advantageous when an end region of the Venetian blind is fastened on a rod which is rotatable by means of a drive unit and when, in the closed position, a first length of the Venetian blind is wound on the rod and, in the open position, a second length of the Venetian blind is wound on the rod, wherein the second length is longer than the first length. Consequently, the Venetian blind, when moving from the closed into the open position, is wound on the rod in a simple manner such that little space is required. For closing, the Venetian blind wound on the rod is unwound again.

In the case of an alternative embodiment, the Venetian blind includes a first end region, a second end region, a fastening region, a first intermediate region which is located between the first end region and the fastening region and a second intermediate region which is located between the second end region and the fastening region. The fastening region of the Venetian blind is fastened on a rod which is rotatable by means of a drive unit, wherein, in the closed position, both the first intermediate region and the second intermediate region in each case close the opening of the thin-walled transport container at least in part, preferably completely. The first and the second end regions are preferably fastened in each case fixedly on the stacking unit. Consequently, the achievement is that the opening is closed twice, wherein the rod, onto which the Venetian blind is wound when opening, is surrounded on two sides by the Venetian blind in the closed position such that no notes of pecuniary value, which have already been supplied to the respective transport container, are able to rest on the rod or on the protective elements that cover the rod. Consequently, said "double" Venetian blind prevents the already supplied notes of pecuniary value being able to catch on the Venetian blind mechanism.

The first and the second intermediate regions are realized in particular in such a manner that they are arranged in the closed position approximately parallel to one another. As a result of the driving of the rotatable rod by means of the drive unit, both intermediate regions on the rod are wound one on top of the other such that the two intermediate regions are moved from the closed into the open position or vice versa.

The rod is arranged in particular in a space which is defined by the first intermediate region and the second intermediate region of the Venetian blind. Consequently, said rod is protected from the Venetian blind surrounding it such that no notes of pecuniary value are able to come into contact with it or with elements that cover it.

In the case of a further alternative embodiment of the invention, instead of one Venetian blind which is fastened on the rod by way of its fastening region and consequently is divided into two part regions each of which is able to close the openings, it is also possible to use two Venetian blinds which are separate from one another, in each case a first end region of said two Venetian blinds being connected to the rod and in each case a second end region being fixedly connected to the stacking unit.

It is particularly advantageous when the Venetian blind, in the closed position, is completely unwound from the rod such that the opening is preferably almost completely closed and only a small amount of material is necessary. In said case, the first length is in particular zero. As an alternative to this, a fastening region of the Venetian blind can also be permanently wound around the rod and consequently fasten the Venetian blind to the rod.

In the open position, in contrast, the Venetian blind is preferably completely wound on the rod such that, all in all, only as short as possible a Venetian blind is necessary.

In addition, it is advantageous when the rod is moved by means of the drive unit in a translatory manner in a predetermined direction for winding and unwinding the Venetian blind and, in this connection, is rotated about its longitudinal axis such that the Venetian blind is wound on or unwound from the rod. To this end, a toothed wheel, which is non-rotatably connected to the rod and engages a fixed-in-position toothed rod, is arranged on at least one end region of the rod. The rod, in turn, is fastened to a belt which is drivable by means of the drive unit. If then the belt is moved by means of the drive unit, the rod is moved in a translatory manner in the direction of the belt. During said translatory movement, as a result of the engagement between the toothed wheel and the toothed rod, the rod is made to rotate such that the Venetian blind is wound on the rod or is unwound from the rod.

It is particularly advantageous when the end region on which the rod is fastened with the belt and the end region on which the toothed wheel is fastened on the rod, are the same end regions. As an alternative to this, the two fastenings can also be provided in a reciprocal manner. In addition, it is possible, as an alternative to this, for both end regions to each comprise a toothed wheel, both of which are guided in two fixed-in-position toothed rods, which are arranged parallel to one another, and engage with the corresponding toothing.

In the case of an alternative embodiment of the invention, the rod can also be arranged fixed in position and can be rotated by the drive unit for winding and unwinding the Venetian blind.

In addition, it is advantageous when the stacking unit includes at least one pressing element which, when stacking the notes of pecuniary value into the stacking region, presses the stack of notes of pecuniary value against the closure unit which is arranged in the closed position. In particular, the stack of notes of pecuniary value is pressed against the Venetian blind such that the first note of pecuniary value of the stack of notes of pecuniary value, i.e. that note of pecuniary value which was supplied the first, is pressed by way of its front or rear side against the Venetian blind. The notes of pecuniary value are stacked upright on a supporting element in particular on their edges and abut against one another by way of the front and/or rear sides.

The pressing element preferably includes at least one impeller which is mounted on a shaft, the impeller being arranged so as to be non-rotatable on the shaft and the shaft being rotatable by means of a drive unit. When the shaft is driven, the impeller, by way of its blades, presses at least one note of pecuniary value supplied to the stacking unit for stacking into the stacking region against a first end face of the stack of notes of pecuniary value. As a result, the impeller additionally presses a second end face of the stack of notes of pecuniary value, which is located opposite the first side, against the closure unit. The notes of pecuniary value are able to be supplied in a simple manner and stacked in the stacking region by means of such an impeller. In particular, compared to the supplying by means of stacker wheels, it is possible for the spacing between two successively supplied notes of pecuniary value to be minimized, in an optimum manner to be realizable at a spacing of zero. In particular, the advantage of impellers compared to stacker wheels is that the notes of pecuniary value do not have to be received in receiving regions that are realized between the blades such that corresponding clocking between the supplying of the notes of pecuniary value and the respective position of rotation of the stacker wheels is not necessary.

In addition, it is advantageous when there are provided several impellers which are each arranged in a non-rotatable manner on the shaft. Consequently, it is achieved that a supplied note of pecuniary value, over its entire length, is better guided and pressed against the stack of notes of pecuniary value by the blades of the impellers. Five impellers which are preferably identically constructed are provided in particular.

In particular, each impeller has four resilient blades which impact against the note of pecuniary value supplied the last when the impeller is rotated and consequently press said note of pecuniary value against the stack of notes of pecuniary value and the entire stack of notes of pecuniary value against the Venetian blind.

In addition, it is advantageous when on the same shaft on which the impellers are also arranged, rollers are arranged so as to be non-rotatable relative to the shaft, by means of said rollers together with counter pressure rollers which are arranged on a further shaft, the notes of pecuniary value are supplied to the stacking region before said notes of pecuniary value are pressed against the stack of notes of pecuniary value by means of the blades of the impellers. Consequently, a particularly secure, reliable supplying of the notes of pecuniary value is realized with a simple, compact design.

The blades of the at least one impeller are in particular elastically deformable and, when the drive is driven, impact against the note of pecuniary value supplied the last.

In addition, it is advantageous when the stacking unit includes a supplying element for supplying the stack of notes of pecuniary value stacked in the stacking region into the receiving region of the thin-walled transport container. The supplying element, for this purpose, is moved in particular in a translatory manner between an initial position where it is arranged outside the stacking region and outside the receiving region, into a supplying position in which it projects through the stacking region as far as into the receiving region. The supplying element is initially moved in a first step in such a manner that it presses the stack of notes of pecuniary value against the closure unit which is arranged in the closed position. In a second step which follows the first step, the drive unit moves the closure unit into the open position, before the supplying element, in a third step, moves the stack of notes of pecuniary value into the receiving region of the thin-walled transport container, wherein the supplying element is then arranged in the supplying position and is arranged through the stacking region at least in part inside the thin-walled transport container. Secure supplying of the stack of notes of pecuniary value into the receiving region of the thin-walled transport container is achieved in this way.

The supplying element is also designated in particular as a tamper. When the stack of notes of pecuniary value is supplied to the receiving region, the supplying element preferably projects through the supplying region into the receiving region and in this connection is moved in a translatory manner.

In the case of a particularly preferred embodiment, once the stack of notes of pecuniary value have been supplied, the drive unit, in a fourth step which follows the third step, moves the closure unit into a retaining position in which the closure unit is arranged in a position between the open position and the closed position. In said retaining position the closure unit is arranged in such a manner that the supplying element is able to project through the stacking region into the thin-walled transport container, the supplied notes of pecuniary value, however, are held back in the receiving region by the closure unit. Consequently, it is ensured that the supplying element is able to be moved back from the supplying position into the initial position again without, in this connection, the notes of pecuniary value, which are received in the receiving region of the thin-walled transport container, falling through the opening as they are held in the receiving region by the closure unit which is arranged in the retaining position. The closure unit is arranged in the retaining position in particular centrally between the open and the closed position.

In the case of the embodiment where the closure unit includes a Venetian blind, said Venetian blind, in the retaining position, is wound on the rod by a third length, wherein said third length is longer than the first length and shorter than the second length.

In the case of a particularly preferred embodiment, in a fifth step which follows the fourth step, the supplying unit is moved again in such a manner that it is arranged in the initial position, i.e. outside the stacking region, before in a sixth step the drive unit then moves the closure unit into the closed position. Consequently, further notes of pecuniary value can then be stacked in the stacking region to form a new stack of notes of pecuniary value such that, all in all, it is possible to supply stacks of notes of pecuniary value gradually in a secure manner to the thin-walled transport container in this way.

In addition, the invention relates to a method for filling a thin-walled transport container comprising an opening with notes of pecuniary value, where, in a first step, the notes of pecuniary value are stacked by means of a stacking unit in a stacking region to form a stack of notes of pecuniary value, wherein the stack of notes of pecuniary value is pressed by means of a driven impeller against a closure unit which is arranged in a closed position in front of the opening of the thin-walled transport container. In a second step a supplying element, which is arranged beforehand in an initial position outside the stacking region, is moved in such a manner that it presses the stack of notes of pecuniary value against the closure unit before, in a third step, the closure unit is then moved from the closed into an open position in which the closure unit no longer closes the opening and consequently notes of pecuniary value are able to be supplied to the thin-walled transport container. The stack of notes of pecuniary value is then is moved by means of the supplying element through the opening of the thin-walled transport container into a receiving region of the thin-walled transport container. Then in a fifth step, the closure unit is moved into a retaining position in which the supplying element is movable through the opening, but the notes of pecuniary value are held in the receiving region. In a sixth step, the supplying element is moved back again into its original position in such a manner that it is arranged outside the receiving region and outside the stacking region.

Then in a seventh step, the closure unit is moved into the closed position again so that once again notes of pecuniary value can be stacked in the stacking region. All in all, a secure supplying of notes of pecuniary value to thin-walled transport containers and nevertheless a compact, simple design of the stacking unit are achieved as a result of the method described beforehand.

The method described beforehand can be further developed in an analogous manner to the device described beforehand. In particular, the method can be further developed by way of the features or corresponding method features provided in the dependent claims which are dependent on the device.

Further features and advantages of the invention are produced from the following description which explains the invention by way of exemplary embodiments in conjunction with the accompanying figures.

DETAILED DESCRIPTION OF THE PREFERRED EMBODIMENTS

Figure 1:
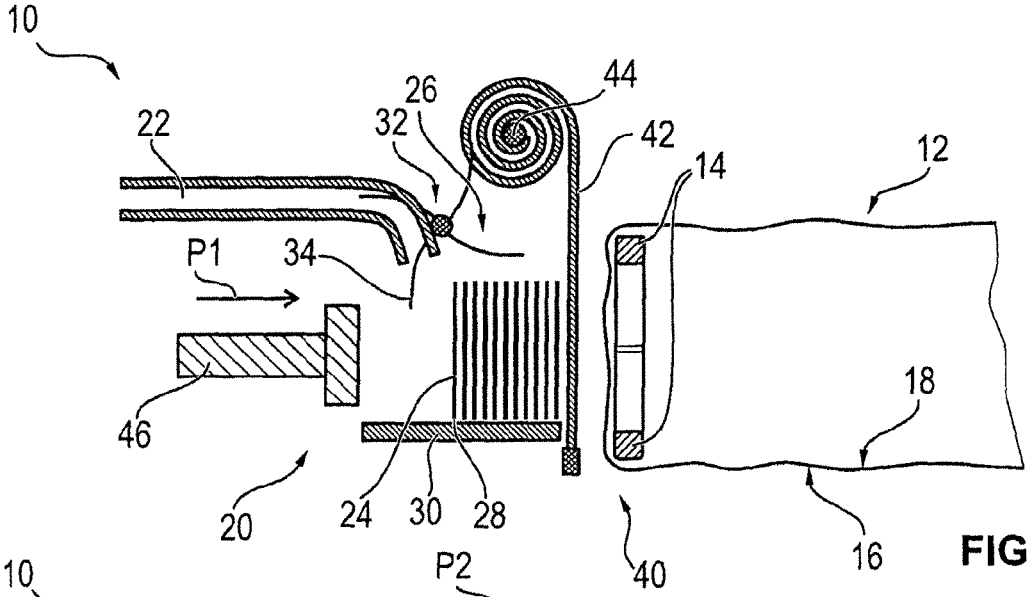
FIG. 1 shows a schematic representation of a device for supplying notes of pecuniary value to a thin-walled transport container according to a first embodiment in a first operating state.

FIG. 1 shows a schematic representation of a device 10 for supplying notes of pecuniary value to a thin-walled transport container 12 in a first operating state. The thin-walled transport container 12 is, in particular, a thin plastic bag in which the notes of pecuniary value are received for subsequent transport. Such a plastic bag for receiving notes of pecuniary value is frequently also designated as a safebag.

To fill with the notes of pecuniary value, the safebag 12 is rotated to the left such that, as long as no notes of pecuniary value are received therein, its inside surface 16 is directed outward and its outside surface 18 is directed inward. The safebag 12 is inverted over a closure frame 14, as a result of which an opening is realized through which the notes of pecuniary value can be supplied to the safebag 12. Once the safebag 12 has been completely filled with notes of pecuniary value, the oppositely situated elements of the closure frame 14 are moved toward one another, as a result of which the opening of the safebag 12 is irreversibly closed. In particular, there are provided latching elements which latch into one another to close the safebag 12 such that they are not able to be released again in a non-destructive manner such that access to the notes of pecuniary value received in the safebag 12 is only possible by destroying the closure frame 14 and/or the safebag 12 itself.

The device 10 includes a stacking unit 20 which has a supplying channel 22, along which the notes of pecuniary value to be supplied to the safebag 12, of which one is designated with the reference 24 as an example, are suppliable into a stacking region 26 in which the notes of pecuniary value 24 are stacked with their edges 28 resting on a supporting element 30 to form a stack of notes of pecuniary value.

The stacking unit 20 comprises at least one impeller 32 which includes several blades 34, a note of pecuniary value to be supplied to the stacking region 26 being stacked by means of the blade 34 of the impeller 32 by the note of pecuniary value supplied the last being pressed against the other notes of pecuniary value 24 of the stack of notes of pecuniary value by the blades 34 impacting against the note of pecuniary value supplied the last and consequently against a first end face of the stack of notes of pecuniary value.

In addition, the device 10 includes a closure unit 40 which is arranged in a closed position shown in FIG. 1 in such a manner that it closes the stacking region 26 in the direction of the safebag 12 and consequently closes the opening of the safebag 12 such that the notes of pecuniary value 24 are not yet able to be supplied to the safebag 12. By means of the impeller 32, the stack of notes of pecuniary value is pressed against the closure unit 40 which is arranged in the closed position such that a second end face of the stack of notes of pecuniary value which is located opposite the first end face contacts the closure unit 40. The achievement here is that a region located in front of the first end face of the stack of notes of pecuniary value is kept open such that the notes of pecuniary value 24 supplied by means of the supplying channel 22 are able to be supplied in an unobstructed manner to said region.

The closure unit 40 is realized in particular in the form of a Venetian blind 42 which is arranged fixedly on a rotatable rod 44. In the closed position, the Venetian blind 42 is wound to the greatest degree from the rod 44 such that the opening of the safebag 12 is closed.

Once all the notes of pecuniary value 24 of the stack of notes of pecuniary value to be supplied have been stacked in the stacking region 26 to form a stack of notes of pecuniary value, a supplying element 46 of the stacking unit 20, which is also called a tamper, is moved from an initial position in which it is arranged outside the stacking region 26 by such an amount in a translatory manner in the direction of the arrow P1 that it presses against the first end face of the stack of notes of pecuniary value and consequently presses the stack of notes of pecuniary value against the Venetian blind 42. Said first operating state is shown in FIG. 1.

Figure 2:
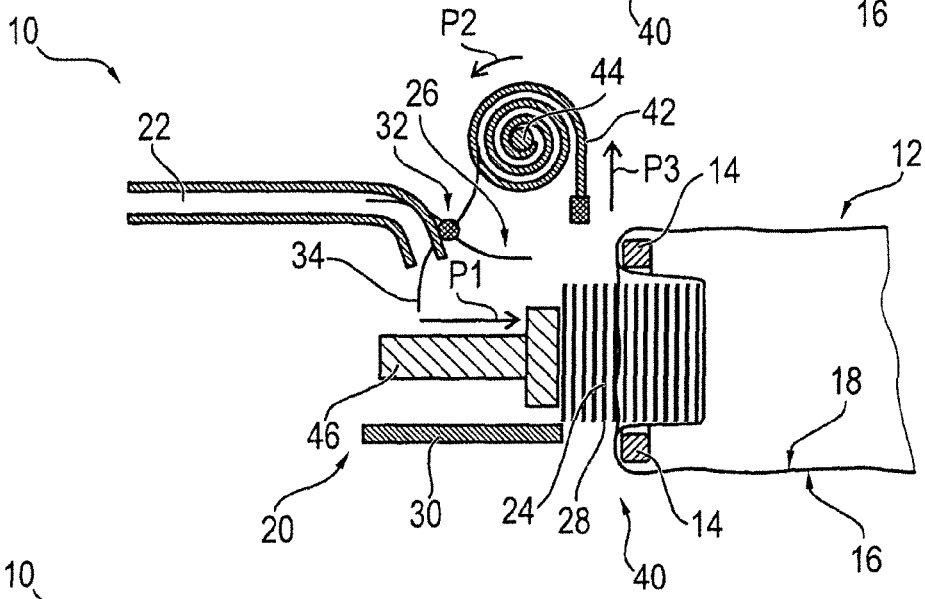
FIG. 2 shows a schematic representation of the device of the thin-walled transport container according to FIG. 1 in a second operating state.

As shown in the second operating state in FIG. 2, the rod 44 is then rotated in the direction of the arrow P2 such that the Venetian blind 42 is moved in the direction of the arrow P3 by being wound on the rod 44 until it is arranged in an open position shown in FIG. 2 in which it opens up the opening of the safebag 12 at least by such an amount that the notes of pecuniary value 24 of the stack of notes of pecuniary value are able to be supplied to the safebag 12. Once the Venetian blind 42 has been arranged in the open position, the supplying element 46 is moved further in the direction of the arrow P1 such that it supplies the stack of notes of pecuniary value to the safebag 12, wherein it presses against the outwardly inverted inside surface 16 of the safebag 12 and consequently gradually turns the safebag 12 the other way out such that the inside surface 18 of the safebag 12 is once again arranged on the inside and the notes of pecuniary value 24 contact the same.

Once the notes of pecuniary value 24 of the stack of notes of pecuniary value have been supplied to the safebag 12, the rod 44 is rotated in opposition to the direction P2 such that the Venetian blind 42 is unwound from the rod 44 and is consequently moved in the direction of the arrow P4, that is in opposition to the direction of the arrow P3, until the Venetian blind 42 is arranged in a retaining position in which it closes the opening of the safebag 12 in part, but it is only open by such an amount that the supplying element 46 is still able to be moved back in the direction of the arrow P5, that is in opposition to the direction of the arrow P1, into the initial position. The achievement consequently is that the notes of pecuniary value supplied to the safebag 12 are held back by the Venetian blind 42 which is arranged in the retaining position and the supplying element 46 is nevertheless able to be moved back into the initial position such that it is possible to deposit the notes of pecuniary value securely in the safebag 12. This state is shown in FIG. 3.

Once the supplying unit 46 is arranged in its initial position again, the Venetian blind 42 is unwound further from the rod 44 until it is once again arranged in the closed position. Consequently, further notes of pecuniary value 24 can now be stacked in the stacking region 26 to form a new stack of notes of pecuniary value which can then be supplied to the safebag 12 in an analogous manner to the previously described method.

The Venetian blind 42 is wound on the rod 44 in the closed position in particular by a first length, in the open position by a second length and in the retaining position by a third length, wherein the first length is shorter than the third length and the third length, in turn, is shorter than the second length.

Figure 3:
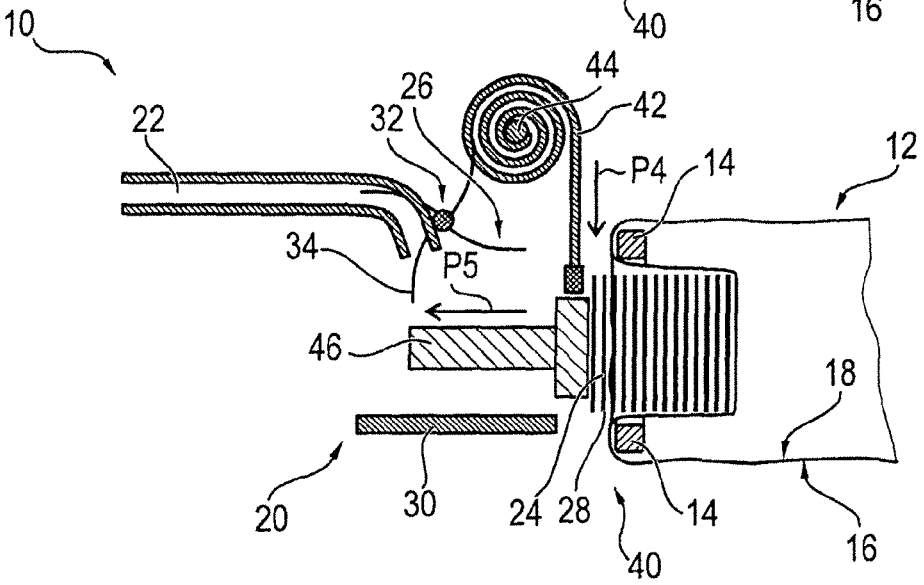
FIG. 3 shows a schematic representation of the device and of the thin-walled transport container according to FIGS. 1 and 2 in a third operating state.

In the case of the first embodiment shown in FIGS. 1 to 3, the Venetian blind 42 is wound onto a rod 44 which is fixed in position. As described below in more detail in conjunction with FIGS. 4 to 8, the Venetian blind can, however, also be wound on a rod moved in a translatory manner in the direction of the arrows P3 or P4 such that a particularly simple, compact design is achieved.

Figure 4:
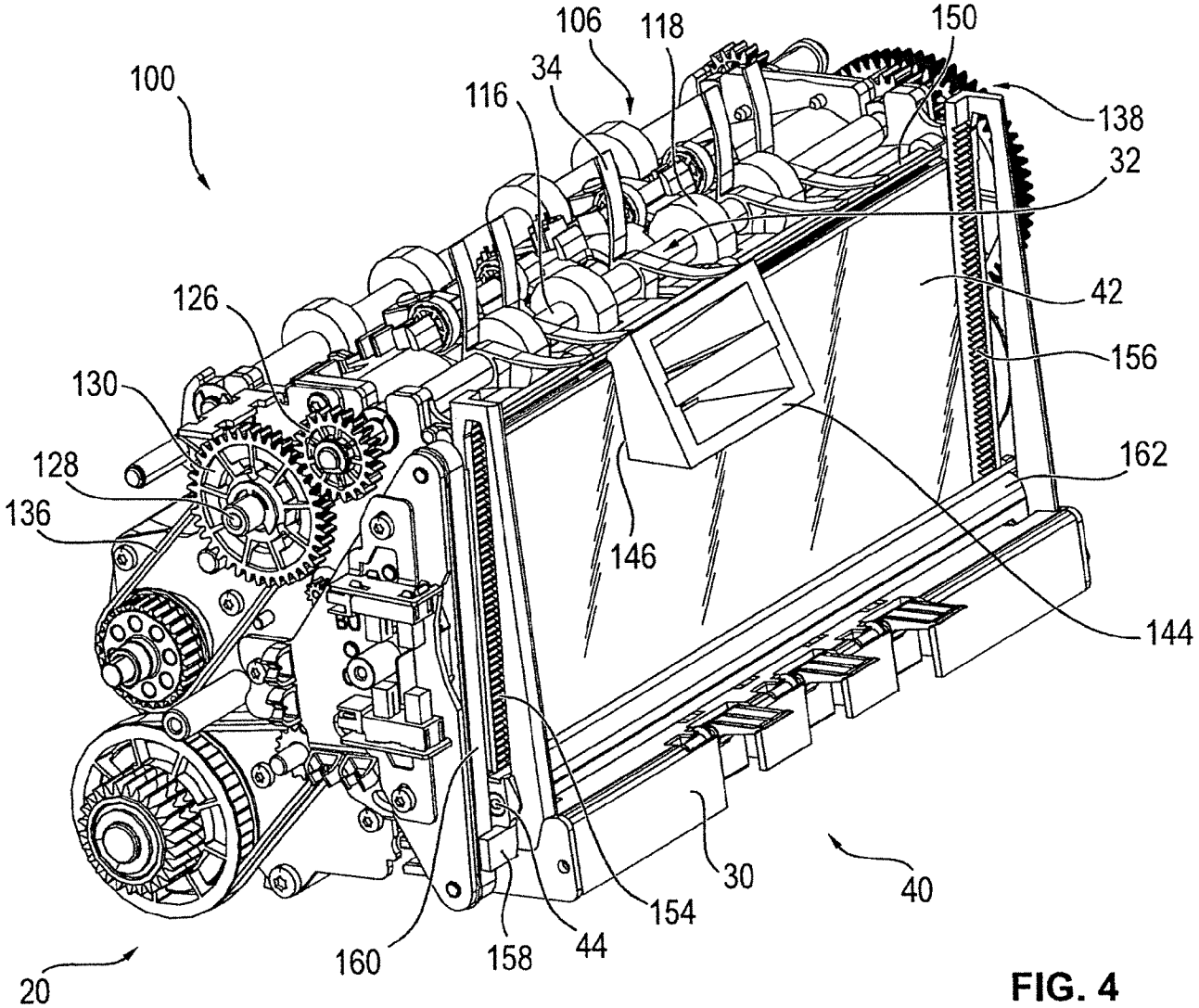
FIG. 4 shows a schematic, perspective representation of a device for supplying notes of pecuniary value to a thin-walled transport container according to a second embodiment, looking onto a rear side of the device.

FIG. 4 shows a schematic, perspective representation of a device 100 for supplying notes of pecuniary value to a safebag 12 (not shown) according to a second embodiment. Elements with the same design or the same function have the same references. FIG. 4, in this connection, shows a direction of view onto a rear side of the device 100, said rear side being that side on which the safebag 12 is arranged.

Figure 5:
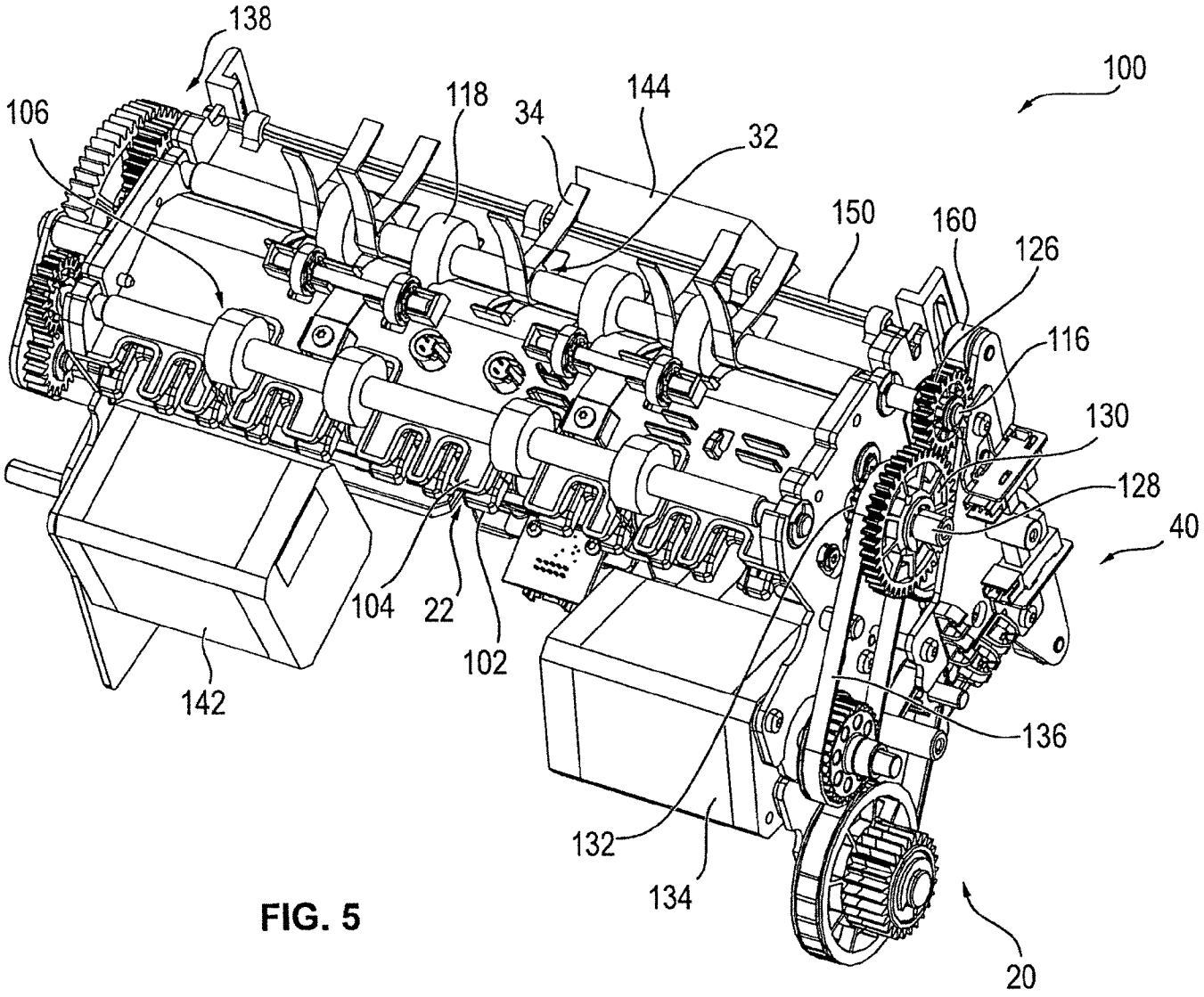
FIG. 5 shows a further schematic, perspective representation of the device according to FIG. 4, looking at a front side.
Figure 6:
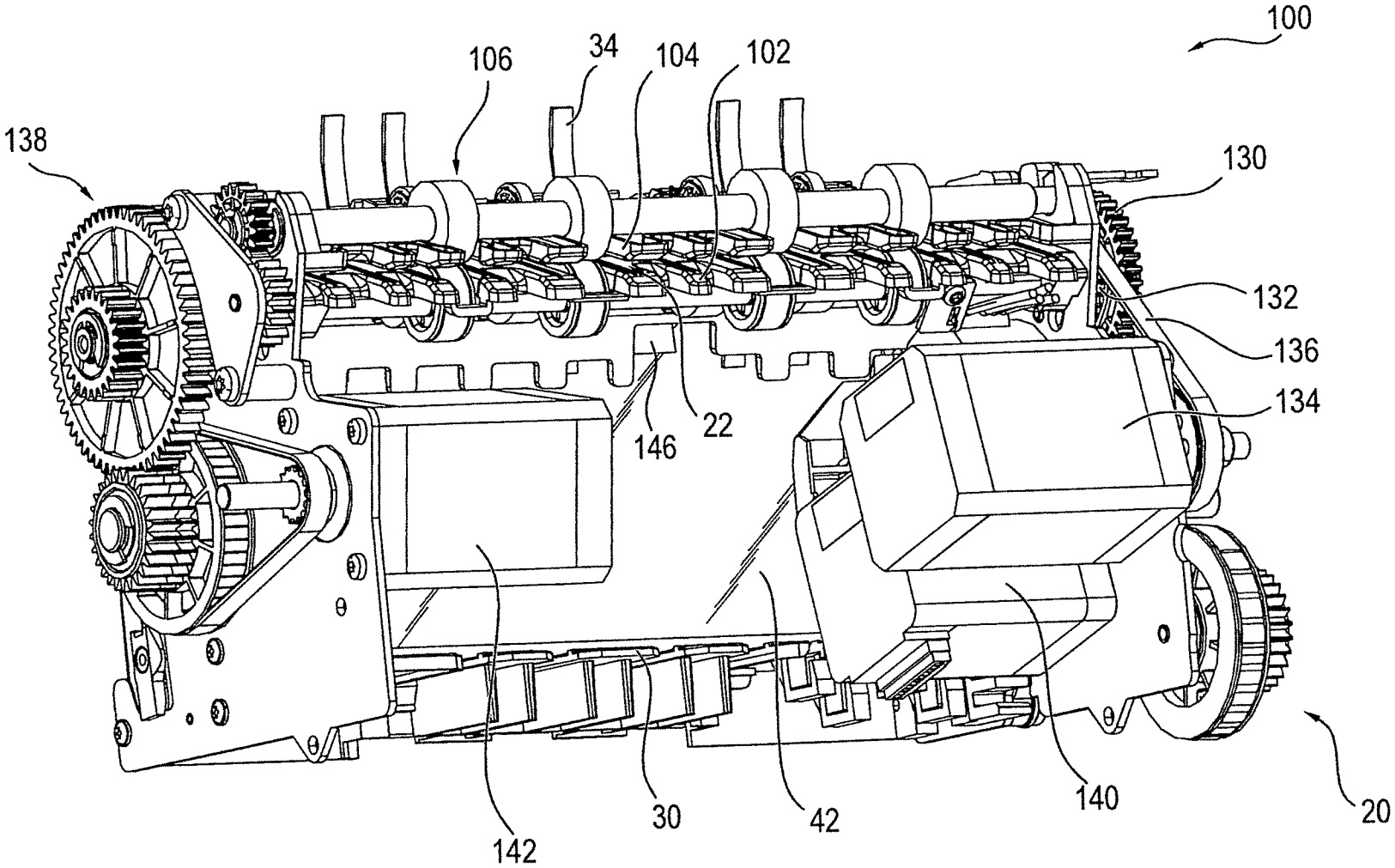
FIG. 6 shows a further schematic, perspective representation of the device according to FIGS. 4 and 5 looking at the front side.
Figure 7:
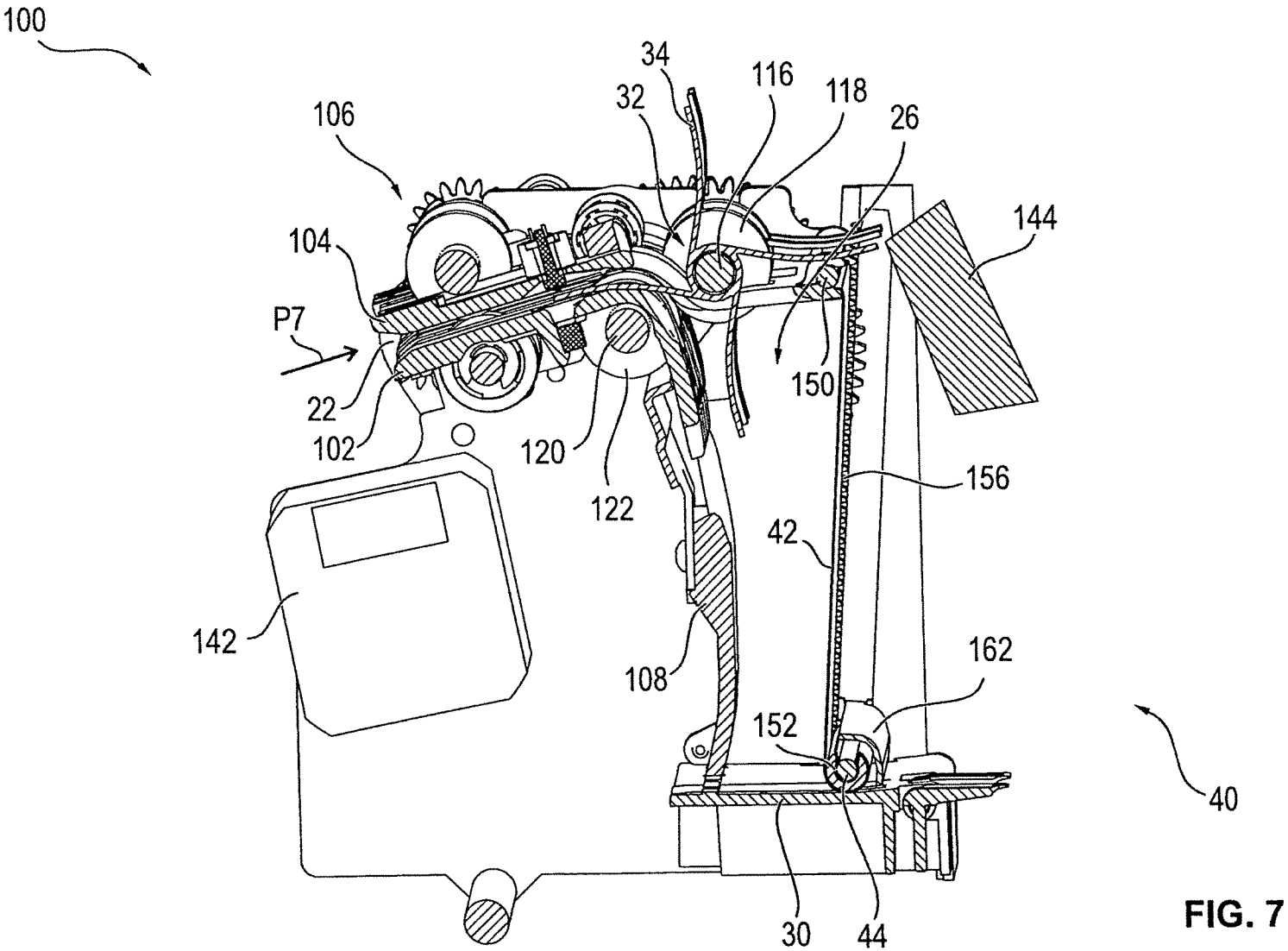
FIG. 7 shows a sectional representation through the device according to FIGS. 4 to 6.

FIGS. 5 and 6 each show a schematic, perspective representation of the device 100, looking at a front side which is located opposite the rear side. FIG. 7 shows a sectional representation through the device 100 according to FIGS. 4 to 6.

The stacking unit 20 comprises a first guiding element 102 and a second guiding element 104, between which is realized the supplying channel 22 for supplying the notes of pecuniary value 24, the notes of pecuniary value 24 being supplied in the direction of the arrow P7 to the stacking unit 20 by a supplying unit which is not shown. Several pairs of rollers, one of which is shown as an example with reference 106, project through the guiding elements 102, 104. The notes of pecuniary value are transported by said pairs of rollers 106 in the direction of the arrow P7 to the stacking region 26, for which purpose at least one roller of each pair of rollers 106 is driven. The notes of pecuniary value 24, in this connection, are deflected by the predefined angle, in particular by approximately 90 degrees, such that they rest with their edges on the supporting element 30.

The stacking region 26 is defined by the supporting element 30, the closure unit 40, in particular the Venetian blind 42, as well as by a rear wall 108. The notes of pecuniary value 24 are supplied to the stacking region 26 in the region of the rear wall 108 and by means of the blades 34 of the impeller 32 are pressed away from the rear wall 108 against the Venetian blind 42 such that a region between the stack of notes of pecuniary value supplied up to now and the rear wall 108 is opened up for the supplying of further notes of pecuniary value 24.

A total of five impellers 32, which are also designated as paddle wheels, are provided in the case of the second embodiment. Each impeller 32 comprises four symmetrically arranged blades 34 which are elastically deformable such that they are deformed by other components of the stacking unit 20 when rotating about the longitudinal axis of the impeller 32 which means that not the entire radius of the impeller 32 has to be left free, but the blades 34 are bent by the other components and do not impact against the notes of pecuniary value 24 until in the stacking region 26.

The impellers 32 are arranged on a common shaft 116 and are non-rotatably connected to said shaft. In particular further rollers 118, which, together with further rollers 122 which are arranged on a further shaft 120, form pairs of rollers by means of which the supplied notes of pecuniary value are transported in the direction of the stacking region 26, are also arranged on the shaft 116. Consequently, a particularly simple and compact design is achieved. In particular, it is consequently ensured that the impellers 32 and the rollers 118, 122 are driven at the same speed such that it is possible to supply notes of pecuniary value in a reliable manner. In particular, as a result of the supplying by means the impellers 32, it is possible to supply the notes of pecuniary value 24 to the stacking region 26 at a minimum spacing between one another, in particular at absolutely no spacing between one another, and nevertheless to stack them securely.

A toothed wheel 126, which meshes with a toothed wheel 130 arranged on a journal 128, is arranged on one end region of the shaft 116. A further toothed wheel 132, which engages with a toothed belt 126 which is driven by means of a first step motor 134, is arranged on the journal 128 such that the shaft 116 is drivable in a simple manner by means of the step motor 134, as a result of which the impellers 32 are consequently also made to rotate.

A further toothed wheel arrangement 138, by means of which the shaft 116 is coupled with the shaft 120, is provided on an end region of the shaft 116 which is located opposite the region on which the toothed wheel 126 is arranged such that the shaft 120 is also simultaneously driven.

The stacking unit 20 includes two further step motors 140, 142, one of said two step motors 140, 142 serving to move the closure unit 46 (not shown) and the other of the two step motors 140, 142 serving to close the closure frame 14. To simplify the representation, the corresponding transmission means for transmitting the force from the step motors 140, 142 to the supplying unit 46 or to the closure unit for closing the closure frame 14 are not shown.

Over and above this, the stacking unit 20 comprises a sensor unit 144, by means of which the notes of pecuniary value 24 to be stacked are able to be detected, the detecting region of the sensor unit 144 being directed, in particular, through a recess 146 of the Venetian blind 42. To simplify the representation, the sensor unit 144 is not shown in FIG. 6.

Figure 8:
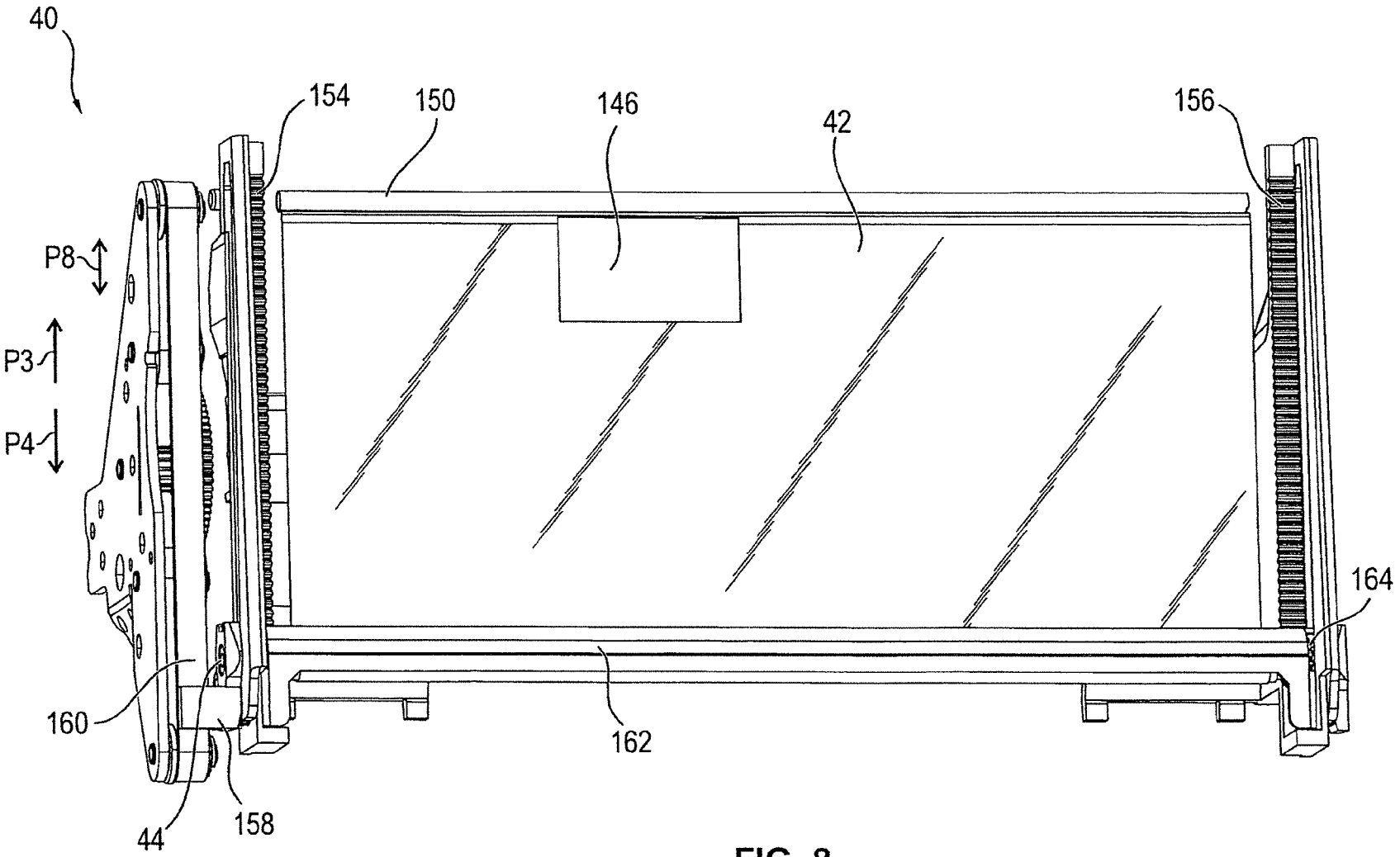
FIG. 8 shows a schematic, perspective representation of a closure unit of the device according to FIGS. 4 to 7.

FIG. 8 shows a schematic, perspective representation of the closure unit 40 in the closed position. A first end 150 of the Venetian blind 42, in this connection, is fastened fixedly on the stacking unit 20. The second end 152 of the Venetian blind 42 which is located opposite the first end 150 is fastened on the rod 44. A toothed wheel 164, which is non-rotatably connected to the rod 44 and which in each case engages in a fixed-in-position toothed rod 154, 156 of the closure unit 40, is arranged in each case on the end regions of the rod 44. In addition, a clamp 158 is arranged on one end region of the rod 44, the rod 44 being connected to the clamp 158 in such a manner that it is mounted on said clamp so as to be rotatable in relation to the clamp 154.

The stacking unit 20 includes a further step motor which is covered by other components in FIGS. 4 to 7 and is consequently not visible. By means of said further step motor, a belt 160, which is guided by means of several toothed wheels, is movable in the direction of the double arrow P8. The clamp 158 is connected to the belt 160 by means of a clamping connection such that the clamp 158 is moved simultaneously when the belt 160 moves.

If the belt 160, starting from the position shown in FIG. 8, is moved in the direction of the arrow P3, that is upward, the clamp 158 and consequently the rod 44 are also moved simultaneously in the direction of the arrow P3. As the rod 44 is mounted so as to be rotatable in relation to the clamp 158 and by means of the toothed wheels meshes in the toothed rods 154, 156, the rod 44, in this connection, is made to rotate such that the Venetian blind 42 is wound on the rod 444 such that the Venetian blind 42 is moved from the closed into the open position.

In a corresponding manner, when the belt 160 is moved in the direction of the arrow P4, the rod 44 is also moved in the direction of the arrow P4 and made to rotate correspondingly, as a result of which the Venetian blind 42 is unwound from the rod 44 and is closed.

In addition, the closure unit 40 includes a protective guard 162 which defines a winding space at least in part, inside which the rod 44 is arranged and inside which the Venetian blind 42, in a manner comparable to a Venetian blind housing, is wound in a protected manner.

In the case of an alternative embodiment of the invention, only one toothed rod 154, 156 can also be provided and in a corresponding manner also only one toothed wheel 164. It is equally possible as an alternative to this for clamps 158 and belts 158, 160 to be arranged on both sides of the rod 44 such that the rod 44 is guided in a secure manner on both sides.

The Venetian blind 42 is produced, in particular, from a woven fabric such that said woven fabric comprises good strength and is nevertheless able to be wound on the rod 44 in a simple and space-saving manner. As an alternative to this, the Venetian blind 42 can also be realized from elements which are strung together in the manner of a chain.

In addition, as an alternative to this it is possible to use in place of a Venetian blind 42 a rigid closure unit 40 which is moved in a translatory manner in the direction of the arrows P3 or P4 for closing and opening. The advantage of the Venetian blind 42 compared to such a rigid unit is that it requires less installation space.

Figure 9:
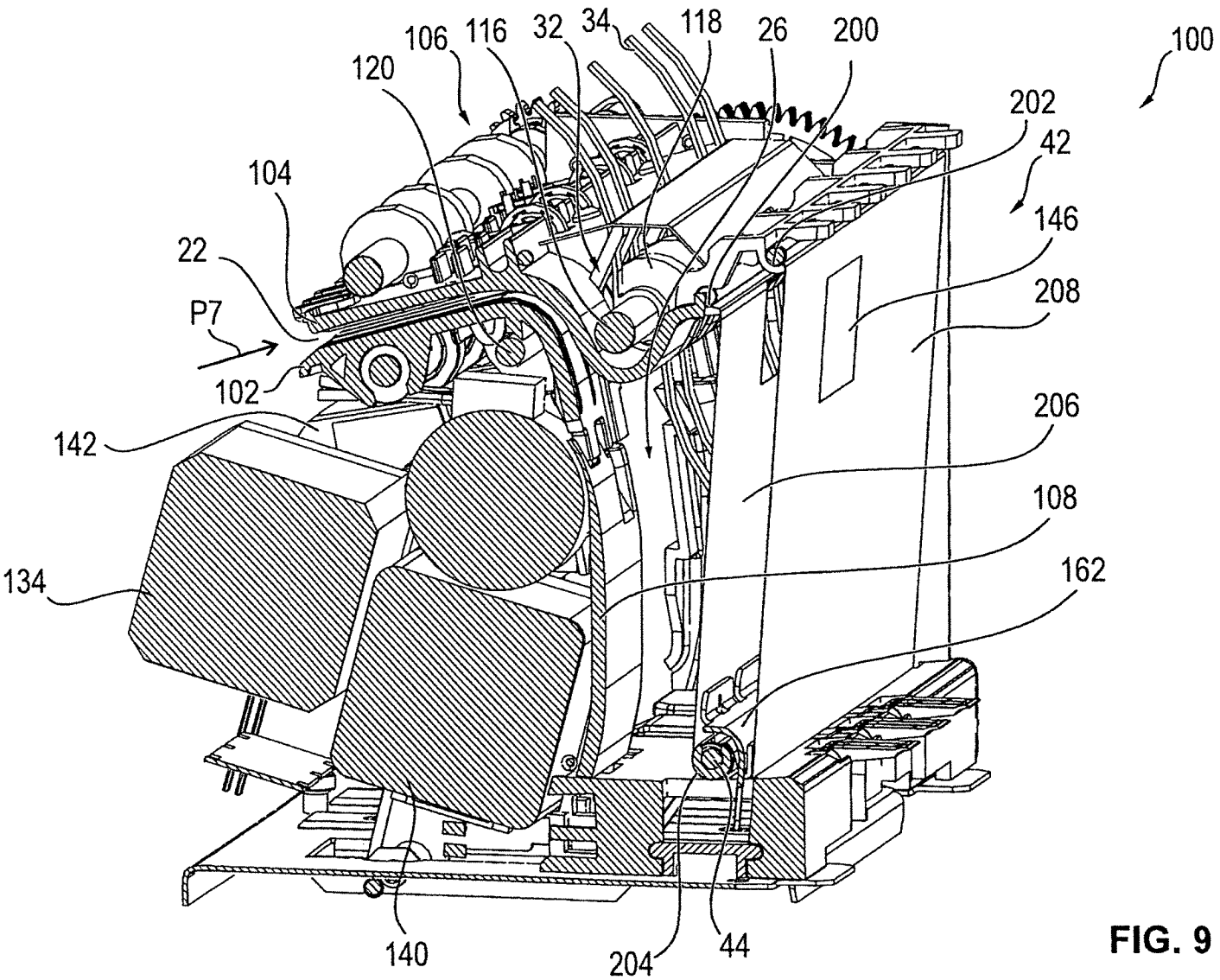
FIG. 9 shows a sectional representation of a device for supplying notes of pecuniary value to a thin-walled transport container according to a third embodiment.

FIG. 9 shows a sectional representation of a device for supplying notes of pecuniary value to a thin-walled transport container 12 according to a third embodiment. The device 100 according to FIG. 9 differs from the device 100 according to the second embodiment according to FIGS. 4 to 8 essentially in that the Venetian blind 42 is divided into two regions 206, 208 which in each case close the opening in the closed position. To this end, a first end region 200 of the Venetian blind 42 and a second part region 202 of the Venetian blind 42 are in each case fastened fixedly on the stacking unit 20. A fastening region 204 is fastened on the rod 44 such that the Venetian blind 42 is consequently divided into a first intermediate region 206 and a second intermediate region 208, the first intermediate region 206 being arranged between the first end region 202 and the fastening region 204 and the second intermediate region 208 being arranged between the fastening region 204 and the second end region 202. Consequently a double Venetian blind 42 is realized which, compared to the second embodiment, ensures that in the closed position no notes of pecuniary value which have already been supplied to the thin-walled transport container 12 rest on the protective guard 162 that covers the rod 44. Consequently, the rod 44 and the protective guard 162 are surrounded on both sides by the two intermediate regions 206, 208 of the Venetian blind 42 such that, in the closed position, no notes of pecuniary value can catch on the rod 44 or on the protective guard 162.

If the rod 44 is moved upward and in this connection is rotated by means of the engagement with the toothed rod 156, both intermediate regions 206, 208 are wound on the rod 44 lying one on top of the other such that the opening is open and notes of pecuniary value are able to be supplied to the thin-walled transport container 12. As a result, the achievement is in particular that both intermediate regions 206, 208 can be opened and closed uniformly and simultaneously by means of only one drive unit. Consequently, a particularly simple design is achieved which is easy to actuate.

In the case of a further alternative embodiment of the invention, two separate Venetian blinds 42 can also be provided, in each case one end region of said Venetian blinds 42 corresponding to the end regions 200 and 202 being fastened on the stacking unit 20 and in each case the other end region of the two Venetian blinds 42 being fastened on the rod 44.

The invention claimed is:

1. A device (10, 100) for filling a thin-walled transport container comprising an opening with notes of pecuniary value, comprising a stacking unit (20) for stacking the notes of pecuniary value (24) to be supplied to the thin-walled transport container (12) in a stacking region (26) arranged outside the transport container (12), to form a stack of notes of pecuniary value; and a closure unit (40) which, in a closed position, closes the opening of the thin-walled transport container (12) by at least an amount such that the stack of notes of pecuniary value is not suppliable to the thin-walled transport container (12), and which, in an open position, is arranged in such a manner that the stack of notes of pecuniary value is suppliable to the thin-walled transport container (12), the closure unit (40) comprising a flexible blind (42) that includes a first end region (200), a second end region (202), a fastening region (204), a first intermediate region (206) between the first end region (200) and the fastening region (204) and a second intermediate region (208) between the second end region (202) and the fastening region (204), the fastening region (204) of the blind (42) being fastened on a rod (44) that is rotatable by a drive unit, and, in the closed position, both the first intermediate region (206) and the second intermediate region (208) close the opening of the thin-walled transport container (12) at least in part.

2. The device (10, 100) of claim 1, wherein the first intermediate region (206) and the second intermediate region (208) are parallel to one another in the closed position.

3. The device (10, 100) of claim 2, wherein the rod (44), in the closed position, is arranged in a space defined by the first intermediate region (206) and the second intermediate region (208) of the blind (42).

4. A device for filling a thin-walled transport container comprising an opening with notes of pecuniary value, comprising a stacking unit (20) for stacking the notes of pecuniary value (24) to be supplied to the thin-walled transport container (12) in a stacking region (26) arranged outside the transport container (12), to form a stack of notes of pecuniary value; and a closure unit (40) which, in a closed position, closes the opening of the thin-walled transport container (12) by at least an amount such that the stack of notes of pecuniary value is not suppliable to the thin-walled transport container (12), and which, in an open position, is arranged in such a manner that the stack of notes of pecuniary value is suppliable to the thin-walled transport container (12), the closure unit (40) including a flexible blind (42) having opposite ends, the closure unit (40) further having a rod (44), at least a part of the blind (42) being wound around the rod (44) and being unwindable from the rod (44) so that at least one of the ends of the blind (42) is selectively movable relative to the rod (44) between the closed position and the open position;

wherein an end region (152) of the blind (42) is fastened on the rod (44) that is rotatable by a drive unit, a first length of the blind (42) being wound on the rod (44) in the closed position and a second length of the blind (42) being wound on the rod (44) in the open position, and the second length being longer than the first length; and wherein the drive unit moves the rod (44) in a translatory manner for winding and unwinding the blind (42) and rotates the rod (44) about its longitudinal axis.

5. A device for filling a thin-walled transport container comprising an opening with notes of pecuniary value, comprising a stacking unit (20) for stacking the notes of pecuniary value (24) to be supplied to the thin-walled transport container (12) in a stacking region (26) arranged outside the transport container (12), to form a stack of notes of pecuniary value; and a closure unit (40) which, in a closed position, closes the opening of the thin-walled transport container (12) by at least an amount such that the stack of notes of pecuniary value is not suppliable to the thin-walled transport container (12), and which, in an open position, is arranged in such a manner that the stack of notes of pecuniary value is suppliable to the thin-walled transport container (12), the closure unit (40) including a flexible blind (42) having opposite ends, the closure unit (40) further having a rod (44), at least a part of the blind (42) being wound around the rod (44) and being unwindable from the rod (44) so that at least one of the ends of the blind (42) is selectively movable relative to the rod (44) between the closed position and the open position;

wherein an end region (152) of the blind (42) is fastened on the rod (44) that is rotatable by a drive unit, a first length of the blind (42) being wound on the rod (44) in the closed position and a second length of the blind (42) being wound on the rod (44) in the open position, and the second length being longer than the first length; and further comprising a toothed wheel (164) non-rotatably connected on at least one end region of the rod (44), the toothed wheel (164) engaging a fixed-in-position toothed rod (154, 156), and the rod (44) being connected fixedly to a belt (160) that is drivable in a direction of the toothed rod (154, 156) by the drive unit.

6. A device for filling a thin-walled transport container comprising an opening with notes of pecuniary value, comprising a stacking unit (20) for stacking the notes of pecuniary value (24) to be supplied to the thin-walled transport container (12) in a stacking region (26) arranged outside the transport container (12), to form a stack of notes of pecuniary value; and a closure unit (40) which, in a closed position, closes the opening of the thin-walled transport container (12) by at least an amount such that the stack of notes of pecuniary value is not suppliable to the thin-walled transport container (12), and which, in an open position, is arranged in such a manner that the stack of notes of pecuniary value is suppliable to the thin-walled transport container (12), the closure unit (40) including a flexible blind (42) having opposite ends, the closure unit (40) further having a rod (44), at least a part of the blind (42) being wound around the rod (44) and being unwindable from the rod (44) so that at least one of the ends of the blind (42) is selectively movable relative to the rod (44) between the closed position and the open position;

wherein an end region (152) of the blind (42) is fastened on the rod (44) that is rotatable by a drive unit, a first length of the blind (42) being wound on the rod (44) in the closed position and a second length of the blind (42) being wound on the rod (44) in the open position, and the second length being longer than the first length;

wherein the stacking unit (20) includes a supplying element (46) for supplying the stack of notes of pecuniary value stacked in the stacking region (26) into the receiving region of the thin-walled transport container (12), the supplying element (46), in a first step, presses the stack of notes of pecuniary value against the closure unit (40) that is arranged in the closed position, a drive unit, in a second step, moves the closure unit (40) into the open position, and the supplying element (46), in a third step, moves the stack of notes of pecuniary value into the receiving region of the thin-walled transport container (12), wherein the supplying element (46) projects through the stacking region (26) and is arranged at least in part inside the thin-walled transport container (12); and wherein, once the stack of notes of pecuniary value has been supplied, the drive unit, in a fourth step, moves the closure unit (40) into a retaining position in which the closure unit is arranged between the open position and the closed position, and in which the closure unit is arranged so that the supplying element (46) is able to project through the stacking region (26) into the thin-walled transport container (12).

7. The device (10, 100) of claim 6, wherein, in the retaining position, the blind (42) is wound on the rod (44) by a third length, and the third length being longer than the first length and shorter than the second length.

8. The device (10, 100) of claim 6, wherein after the fourth step, the supplying unit (46) is moved again in such a manner in a fifth step that it is arranged outside the stacking region (26), and in that the drive unit, in a sixth step, moves the closure unit (40) into the closed position.

* * * * *